US005445175A

United States Patent [19]

Cho

[11] Patent Number: 5,445,175

[45] Date of Patent: Aug. 29, 1995

[54] MEDICAL CRUTCH

[76] Inventor: Kyungil Cho, 132-7, Togun-dong, Koyang-shi, Kyonggi-do, Rep. of Korea

[21] Appl. No.: 254,109

[22] Filed: Jun. 6, 1994

[51] Int. Cl.[6] ..... A61H 3/02

[52] U.S. Cl. ..... 135/68; 135/75

[58] Field of Search ..... 135/68, 69, 72, 75; 248/188.5; 403/105, 106, 108, 261, 331, 375, 384

[56] References Cited

U.S. PATENT DOCUMENTS

| | | | |
|---|---|---|---|
| 4,721,125 | 1/1988 | Wang-Lee | 135/68 X |
| 4,733,682 | 3/1988 | Ellena . | |
| 4,763,680 | 8/1988 | Acosta, Sr. | 135/68 |
| 4,865,065 | 9/1989 | Chen | 135/68 X |
| 5,341,829 | 8/1994 | Hsiao et al. | 135/68 |
| 5,351,701 | 10/1994 | Hsiao | 135/68 |

*Primary Examiner*—Lanna Mai

*Attorney, Agent, or Firm*—Whitham, Curtis, Whitham & McGinn

[57] ABSTRACT

A medical crutch includes a hollow bottom leg member and a pair of hollow side rail members running parallel at a predetermined distance apart, and merged by inflections which are in turn engaged to the bottom leg member at its opposite sides, each of the bottom leg and side members having a cross section of a round-cornered rectangle or an ellipsoid with a flat engagement surface with respect to the adjacent members increasing the resistance to the lateral working loads of the crutch in use and facilitating the assembly of the members as well as the precise punching operations for forming screw holes through which a plurality of screw bolts and nuts fasten the members together; each of the bottom leg and side rail members having a reinforcing means extending inside thereof in a direction vertical to the load-acting lateral direction to prevent a crushing of the member in the punching and a bending operation to form said inflections; and a grip means including concave and convex surfaces formed integral to each of the bottom leg and side rail members to allow a positive locking engagement between the members while reinforcing the members against the punching operations by effecting the corresponding thickened wall to the areas of the members to be punched.

2 Claims, 2 Drawing Sheets

MEDICAL CRUTCH

BACKGROUND OF THE INVENTION

The present invention relates to a crutch for medical applications, and more particularly to a crutch comprised of contoured pipe elements which are adapted to withstand the working loads of the user and the formation pressures during its manufacturing process.

For the sake of assisting the walking activities of many disabled persons, crutches have been widely employed over the past years.

As shown in FIGS. 5 to 7 attached, the conventional structure of these crutches is a bottom leg 100 with a pair of parallel side rails 101 and 101' affixed thereto and extending upwards with a predetermined space therebetween to be connected with a cross member or armpit rest 102 at their top portions.

Between the side rails 101 and 101' an intermediate cross member or hand hold 103 is provided at an adjustable distance corresponding to the length of the arm of the user from the armpit rest 102. Hand hold 103 is adjustably attached to the side rails 101 and 101' by a bolt 104 extending through a selected pair of a plurality of equally spaced holes in the side rails 101 and 101' and the aligned hole in the hand hold 103. The bolt 104 is tightened by a nut 1065, such as a wing nut.

Each of the side rails 101 and 101' is bent at two locations between the upper and lower bolts 104 and 106 to give a converged shape at the corresponding locations of the crutch.

In the past, such crutches had been made of woods but the necessity to the protection of nature and the heavy weights of the wood constructions declined their popularity. As the substitute, aluminum pipes of a circular cross section are being employed to manufacture the crutches.

In order to secure these pipe members to each other, screw holes must be provided at the convex surfaces of the pipe materials which is not an easy task. Even if they are secured successfully, the round surfaces of the members allows line contacts only which cause an insufficient force of engagement between the members resulting in wearings and crackings at the screw bolts before long under the working loads of the crutch. It should be understood that such loosen crutch can no longer give its function.

In an effort to solve this problem, a separate reinforcement 108 was suggested to attach the lower portions of the member 100, 101 and 101' in engagement in order to prevent a loosening or play of the supports during use of the crutch. However, if this reinforcement is not precise and the crutch is used for certain period of time, the members become gradually disengaged causing a feeling of uneasiness of the user all the time.

U.S. Pat. No. 4,733,682 discloses a crutch having a pair of bow members (side rails) which is crushed at their lower ends to remove protruding corners from the bow members for the purpose of achieving a tapered, streamlined, safer configuration. A leg carrier tube (bottom leg) of constant circular cross section is fastened to the bow members at their uncrashed, round surfaces at the upper side and at their crushed flat surfaces at the lower side.

Also, the descriptions of the above patent draws an attention to the fact that the full flattening of the blow members to be in contact with the leg carrier tube had been caused weak points in the crushes.

Furthermore, when the tubular members are subjected to a bending process even under a roller, it is a must to insert a reinforcing core to the inner diameter of the member before the bending operation to prevent a crush or crack otherwise present at the bending point of the member. This is because the bending should be performed on the round surface of the tubular member which, in addition, is made of an aluminum of weak strength. At this instant, only one member at a time could be loaded on the bending machine which is adverse to the profitable productivity.

Another disadvantage resides in the cumbersome and time consuming punching operations wherein a clamping means for holding a pipe against the depressions and a reinforcement core in the tubular member are necessary everytime to secure a precise punching and to prevent a crush in the member. The alternative to this is to use a tubular member of thicker walls which is disadvantageous.

In practical use of the crutch, it is subjected to loads in certain directions, i.e. lateral only. Therefore, with round pipes, a means for reinforcing their engagement in the lateral direction is lacking.

It is an object of the present invention to enhance the engagement force between the tubular elements of the crutches to provide a continued integrity of the crutches without a deforming process for crushing the elements which essentially sacrifices the strength and/or the continued integrity of the crutches.

It is another object of the present invention to provide a means for increasing the resistance of the tubular members to the forming depressions in the bending and punching processes.

SUMMARY OF THE INVENTION

The above and other object of the present invention are accomplished by the provision of a medical crutch comprising a hollow bottom leg member and a pair of hollow side rail members running parallel at a predetermined distance apart, and merged by inflections which in turn are engaged to the bottom leg member at its opposite sides, each of the bottom leg and side members having a cross section of a round-cornered rectangle or an ellipsoid with a flat engagement surface with respect to the adjacent members increasing the resistance to the lateral working loads of the crutch in use and facilitating the assembly of the members as well as the precise punching operations for forming screw holes through which a plurality of screw bolts and nuts fasten said members together; each of said bottom leg and side rail members having a reinforcing means extending inside thereof in a direction vertical to the load-acting lateral direction to prevent a crushing of the member in the punching and a bending operation to form said inflections; and a grip means including concave and convex surfaces formed integral to each of said bottom leg and side rail members to allow a positive locking engagement between the members while reinforcing the members against the punching operations by effecting the corresponding thickened walls to the areas of the members to be punched. Therefore, widenings and tearings of the screw holes are eliminated.

DESCRIPTION OF THE PREFERRED EMBODIMENT

Figures 1, 2A, 2B, 2C, 3, 4, 5, 6, 7:
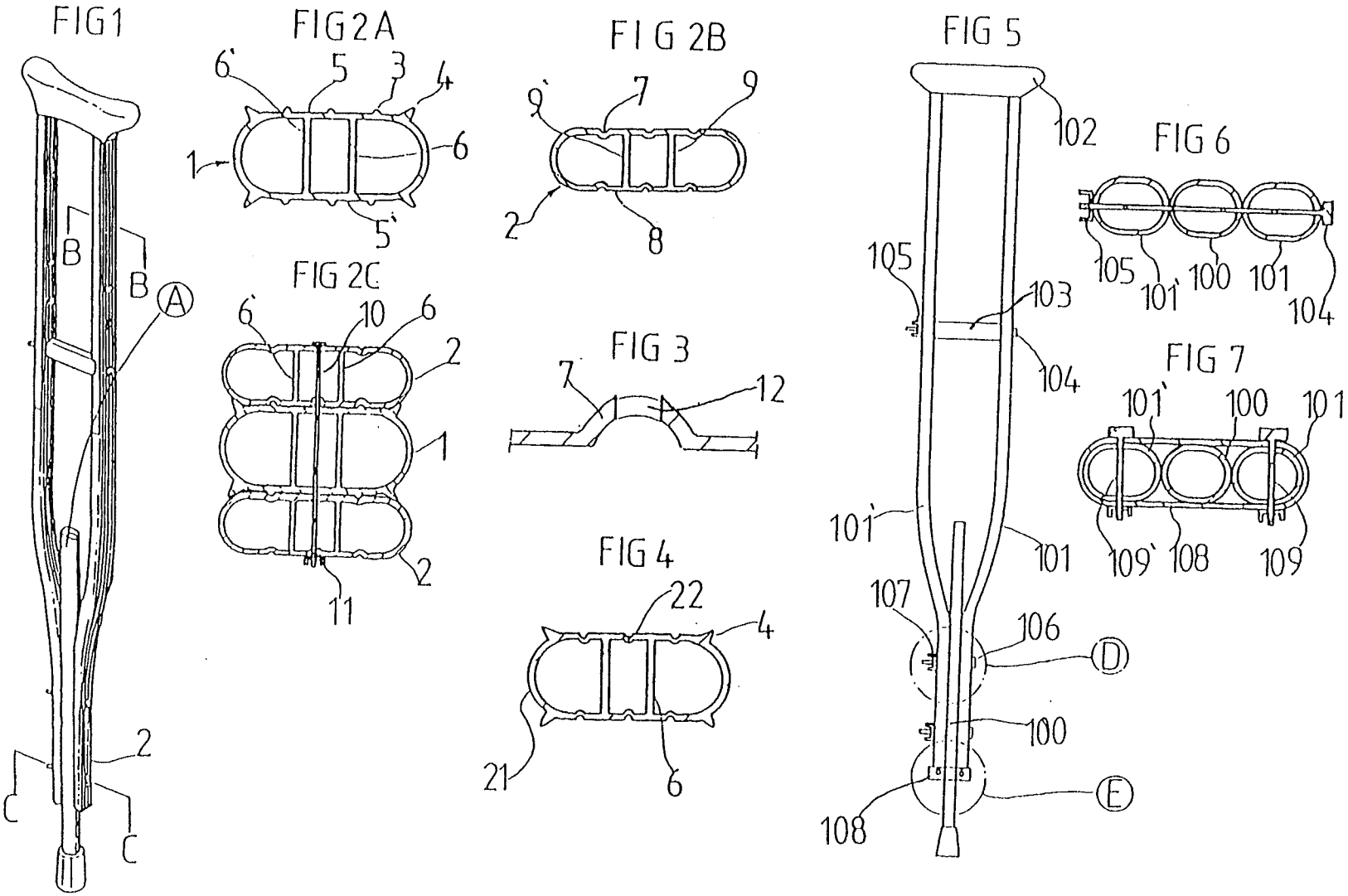
FIG. 1 is a perspective view of a crutch side in accordance with an embodiment of the present invention.
FIG. 2A is a cross-section of a bottom leg of the crutch shown in FIG. 1.
FIG. 2B is a cross-section of a side rail taken on line B—B of FIG. 1.
FIG. 2C is a cross-section, showing an engagement of the bottom leg between a pair of side rails, taken on line C—C of FIG. 1.
FIG. 3 is an enlarged cross-section of a convex zone in the walls of the bottom leg of FIG. 1.
FIG. 4 is a cross-section, similar to FIG. 2A, showing another embodiment of the bottom leg in accordance with the present invention.
FIG. 5 is a view showing a prior art crutch assembly.
FIG. 6 is a cross-section of the crutch assembly at zone (D) of FIG. 5.
FIG. 7 is a cross-section of the crutch assembly at zone (E) of FIG. 5 showing a separate reinforcement attached to the end of the assembly.

Referring now to the drawings, which are not intended to limit the invention, FIGS. 1 to 4 illustrate a unique crutch according to the present invention. The crutch shown in FIG. 1 is generally made of three hollow aluminum pipes and comprises a bottom leg 1 and a pair of side rails 2 and 2' having inflections screw fastened to the opposite sides of the bottom leg 1.

More specifically, the bottom leg 1 is prefabricated so that it has generally flat surfaces 5 and 5' provided with a plurality of protrusions 3. Also, a couple of reinforcing plates 6 and 6' are formed integral to and across the flat surfaces 5 and 5' of the bottom leg 1.

The cross section of the bottom leg 1 is in a generally elliptical shape with the sides in the direction of the major axis extends straight in parallel. Between the flat walls 5 and 5' and the opposite round walls there are formed the corresponding number of corner protrusions as shown in FIG. 2A.

Similarly, the side rails 2 and 2' have flat surfaces 8 with a plurality of grooves formed on the corresponding positions to the protrusions 3 of the bottom leg 1. Between the flat walls 8 of each of the side rails 2 and 2' a couple of transverse plates 9 and 9' are integrally formed.

The cross section of the side rail is also has an elliptical shape which is similar to that of the bottom leg so that when assembled the side rails and the bottom leg is secured together in a positive locking engagement by the complimentary rugged surfaces 5, 5' and 8. In addition, the corner protrusions 4 of the bottom leg 1 help prevent the side rails 2 and 2' from turning aside the bottom leg 1 at the time of assembly due to a slippage among the surfaces 5, 5' and 8. Between the reinforcing plates 6 and 6' of the bottom leg 1 a screw hole 12 is formed passing through the protrusion 3.

Co-axial holes are formed in the side rails 2 and 2' to receive a screw bolt 10.

Therefore, when the side rails 2 and 2' and the bottom leg 1 are brought together for fastening with the screw bolt 10 and a nut 11 the flat surfaces 5, 5', and 8 provide a superior locking engagement in comparison to the conventional line contacts between the round surfaces of the fully tubular elements while dissolving the problem of becoming vulnerable to the lateral loads and torsions and applied to the crutch in use.

This is further assured by the corner protrusions 4, which contains the possible rockings of the side rails 2 and 2' relative to the bottom leg 1.

Additionally, thanks to the presence of the reinforcement plates 6, 6', 9 and 9' in the bottom leg 1 and the side rails 2 and 2' punching operations for simultaneously forming multiple holes by a press are achieved easily without an undesirable crush improving the productivity.

Bending operations are also facilitated by these reinforcement plates because they can withstand by themselves against the relative high bending pressures. This allows the simultaneous bending of multiple crutch elements.

Punching of the screw holes 12 and the fastening works with screw bolts 10 and nuts 11 are dramatically facilitated by adopting the stable flat surfaces 5, 5' and 8.

As shown in detail in FIG. 3, the screw hole 12 is punched at the area of the protrusion 3 effecting a thickened wall to the point where a concentrated load is transmitted via the bolt by having the bolt meet the walls of the bottom leg 1 and the side rails 2 and 2' obliquely rather than vertically to avoid tearings thereat.

According to the present invention, the main axes of the elliptical cross sections of the crutch elements are laterally oriented to increase their strength.

Therefore, the present invention improved provides a functionally crutch in comparison to the existing crutches with circular cross section.

FIG. 4 shows another embodiment of the bottom leg 21 according to the present invention. This embodiment is similar to the embodiment of FIG. 1 except that it has a plurality of grooves 22 as a grip means. It should be understood that the corresponding walls of the side rails may have concave surfaces in accordance with the present invention.

Figure 8:
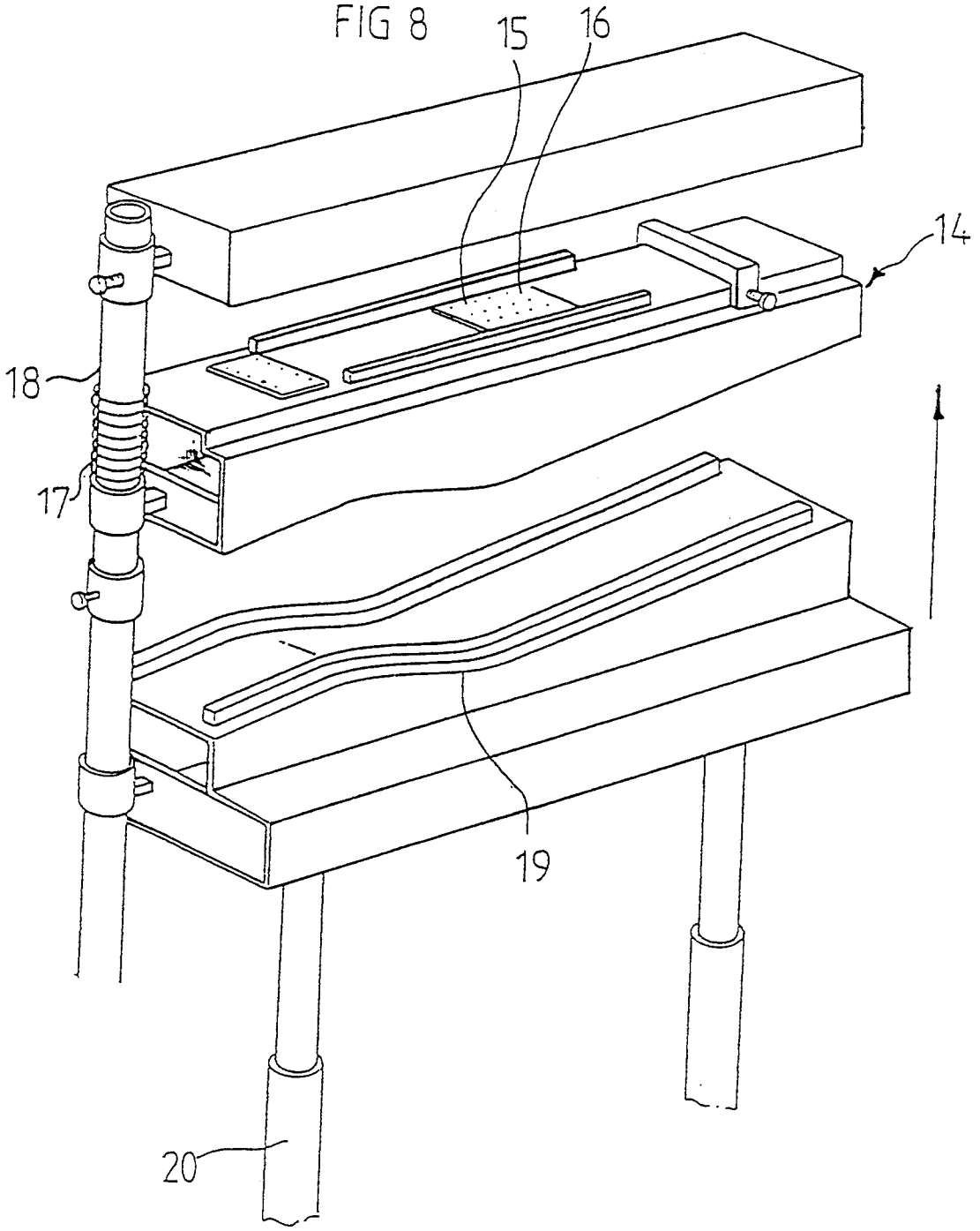
FIG. 8 is a schematic view showing a machine for manufacturing the crutch according to the present invention.

FIG. 8 denotes a machine for bending and punching the crutch members. As can be seen from the drawing, the machine generally comprises a work table 14 having three stages on which a punching and a bending operation are carried out simultaneously under the pressure generated by a hydraulic cylinder 20.

In the punching stage a leveling is schemed by providing an elastic block 16 positioned over pins 15. In order to facilitate the escaping of pins 15 out of the clutch parts after punching, a spring 17 is mounted on a guide 18. For one-step bending, a lower die 19 in a desired profile is pressed against an upper die with the side rail materials sandwiched therebetween.

Although the preferred embodiments of the present invention have been disclosed for illustrative purposes, those skilled in the art will appreciate that various modifications, additions and substitutions are possible, without departing from the scope and spirit of the invention as disclosed in the accompany claims.

What is claimed is:

1. A medical crutch comprising:

a hollow bottom leg member and a pair of hollow side rail members running parallel at a predetermined distance apart, and merged by inflections which are in turn engaged to said bottom leg member at its opposite sides, each of said bottom leg and side members having a cross section of a round-cornered rectangle or an ellipsoid with a flat engagement surface with respect to the adjacent members increasing the resistance to the lateral working loads of said crutch in use and facilitating the assembly of said members as well as the precise punching operations for forming screw holes through which a plurality of screw bolts and nuts fasten said members together;

each of said bottom leg and side rail members having a reinforcing means extending inside thereof in a direction vertical to the load-acting lateral direction to prevent a crushing of the member in the punching and a bending operation to form said inflections;

and a grip means including concave and convex surfaces formed integral to each of said bottom leg and side rail members to allow a positive locking engagement between said members while reinforcing said members against the punching operations by effecting the corresponding thickened walls to the areas of the members to be punched.

2. A medical crutch as claimed in claim 1, wherein said reinforcing means is a couple of plates formed integral to each of said bottom leg and side rail members and spaced to allow the passages of said screw bolts there between.

* * * * *